US009226586B1

(12) United States Patent
Reid

(10) Patent No.: US 9,226,586 B1
(45) Date of Patent: Jan. 5, 2016

(54) OTTOMAN MASSAGING SYSTEM

(71) Applicant: Donald J. Reid, Smithtown, NY (US)

(72) Inventor: Donald J. Reid, Smithtown, NY (US)

( * ) Notice: Subject to any disclaimer, the term of this patent is extended or adjusted under 35 U.S.C. 154(b) by 475 days.

(21) Appl. No.: 13/889,948

(22) Filed: May 8, 2013

(51) Int. Cl.

| | |
|---|---|
| ***A61H 1/00*** | (2006.01) |
| ***A61H 1/02*** | (2006.01) |
| ***A47C 7/74*** | (2006.01) |
| ***A61H 23/02*** | (2006.01) |

(52) U.S. Cl.
CPC ..... *A47C 7/748* (2013.01); *A61H 23/02* (2013.01); *A61H 2201/0138* (2013.01); *A61H 2201/0207* (2013.01)

(58) Field of Classification Search
CPC ... A61H 1/0237; A61H 9/005; A61H 9/0078; A61H 23/00; A61H 23/02; A61H 23/0254; A61H 23/0263; A61H 23/04; A61H 2201/0138; A61H 2201/0142; A61H 2201/0149; A61H 2201/02; A61H 2201/0207; A47C 7/748; A47C 7/50; A47C 7/506; A47C 7/52; A47C 7/503; A47C 16/02; A47C 16/025; A47C 20/021
USPC ..... 601/15
See application file for complete search history.

(56) References Cited

U.S. PATENT DOCUMENTS

| | | | | |
|---|---|---|---|---|
| 2,694,394 | A | 11/1954 | Miller | |
| 4,030,487 | A * | 6/1977 | McEachran | A61H 23/02 601/15 |
| 4,159,714 | A * | 7/1979 | Peterson | A47C 3/02 297/461 |
| 4,989,584 | A | 2/1991 | Simon | |
| D319,352 | S | 8/1991 | Desnoyers | |
| 5,593,212 | A * | 1/1997 | Praria | A47C 16/02 108/143 |
| 2009/0189423 | A1 | 7/2009 | Chi | |
| 2010/0318004 | A1 | 12/2010 | Numata et al. | |
| 2012/0041350 | A1 * | 2/2012 | Nishiguchi | A61H 9/0078 601/148 |

* cited by examiner

*Primary Examiner* — Justine Yu
*Assistant Examiner* — Kathrynn Lyddane

(57) ABSTRACT

A massaging system features an ottoman base, a first cushion, a second cushion, and a third cushion adapted to at least partially surround an appendage of a user. A first cushion first side is located adjacent to a base first side and features a first cushion component, a first heating element, and a first massaging component located inside. A second cushion second side is located adjacent to a base second side and features a second cushion component, a second heating element, and a second massaging component located inside. The third cushion is located between a first cushion second side and a second cushion first side and features a third cushion component, a third heating element, and a third massaging component located inside. The first cushion, the second cushion, and the third cushion are designed to enclose an appendage of a user on three sides.

6 Claims, 4 Drawing Sheets

OTTOMAN MASSAGING SYSTEM

FIELD OF THE INVENTION

The present invention relates to furniture having a massaging component, or more specifically, footstools or ottomans having a massaging component.

BACKGROUND OF THE INVENTION

Massaging systems have been around in various forms for centuries. Today, electrically powered massaging systems are often found either as hand held devices or components that have been implemented into the design of a chair. When using a massaging system that has been implemented into a chair design, the treated areas of the body are generally limited to the trunk of the user. The present invention features a massaging system having an ottoman with positionable cushions adapted to at least partially surround an appendage of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a massaging system having an ottoman with positionable cushions adapted to at least partially surround an appendage of a user. In some embodiments, the system comprises an ottoman base. In some embodiments, the system comprises a first cushion, a second cushion and a third cushion located on a base top surface.

In some embodiments, a first cushion first side is located adjacent to a base first side. In some embodiments, the first cushion comprises a first cushion component, a first heating element, and a first massaging component located inside.

In some embodiments, a second cushion second side is located adjacent to a base second side. In some embodiments, the second cushion comprises a second cushion component, a second heating element, and a second massaging component located inside.

In some embodiments, the third cushion is located between a first cushion second side and a second cushion first side. In some embodiments, the first cushion second side is pivotally located on the third cushion first side. In some embodiments, the second cushion first side is pivotally located on the third cushion second side. In some embodiments, the third cushion comprises a third cushion component, a third heating element, and a third massaging component located inside.

In some embodiments, the system comprises a power supply. In some embodiments, the first cushion, the second cushion, and the third cushion are designed to enclose an appendage of a user on three sides.

DESCRIPTION OF PREFERRED EMBODIMENTS

Figure 1:
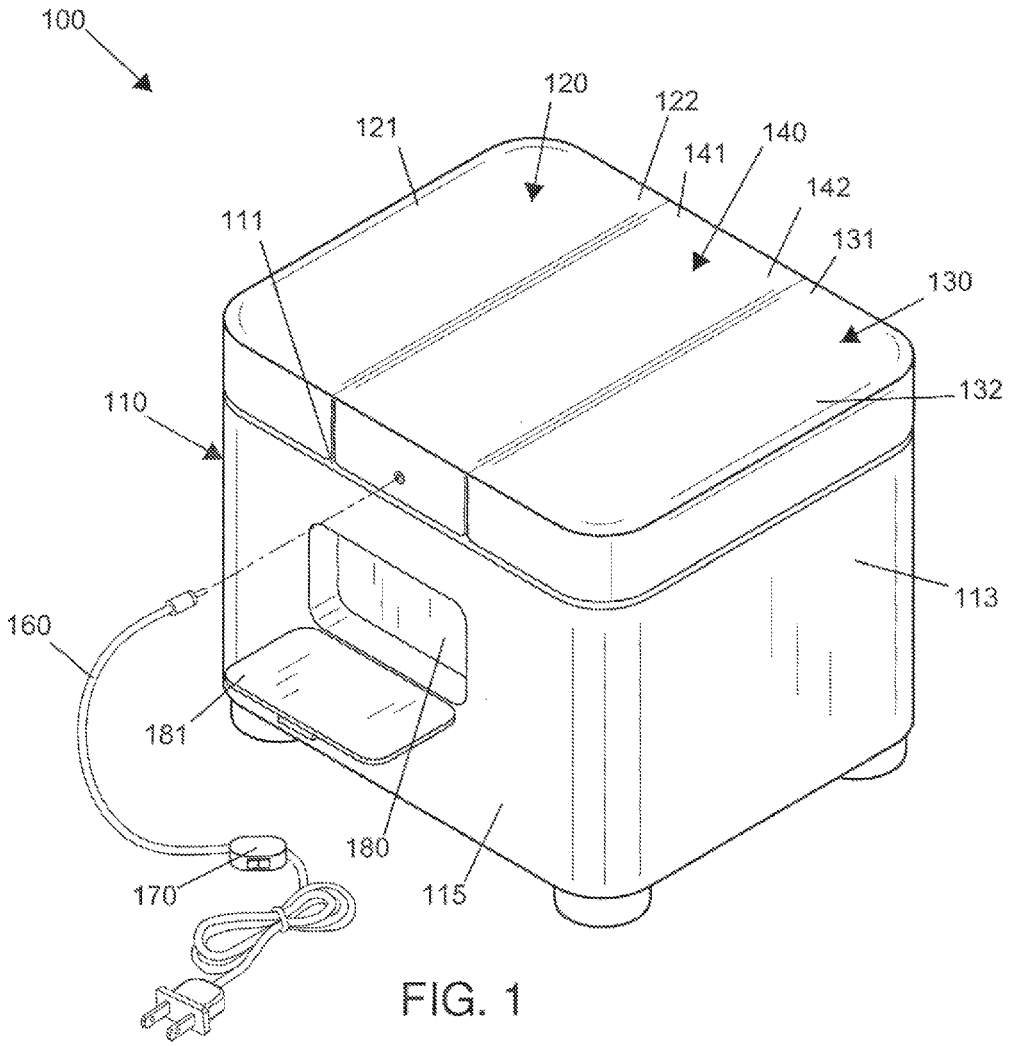
FIG. 1 shows a perspective view of the present invention.
Figure 2:
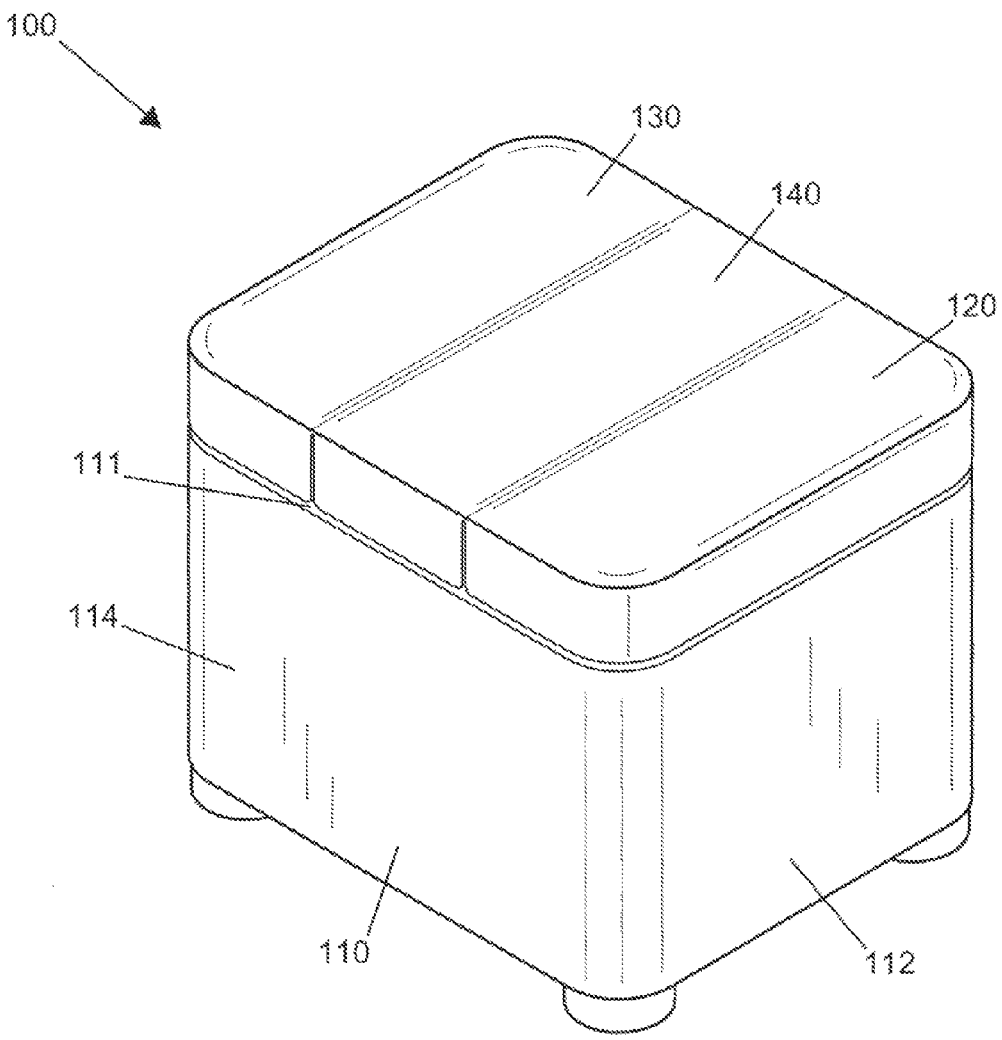
FIG. 2 shows a perspective view of the present invention.
Figure 3:
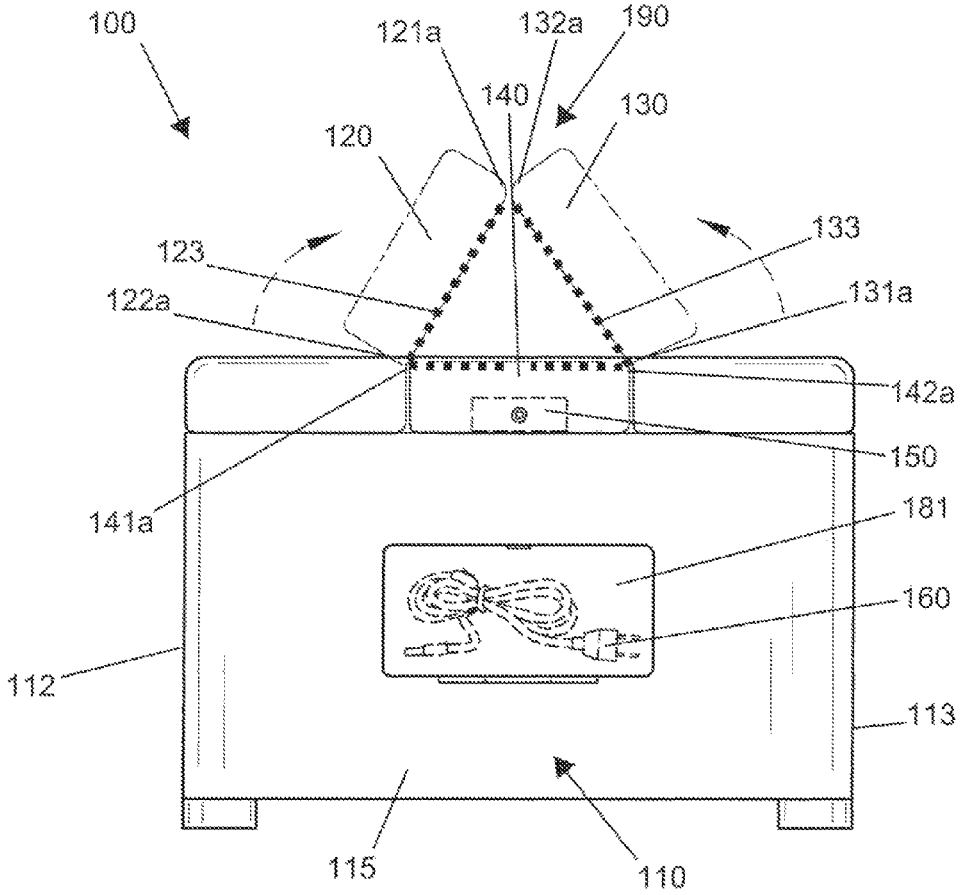
FIG. 3 shows a rear view of the present invention.
Figure 4:
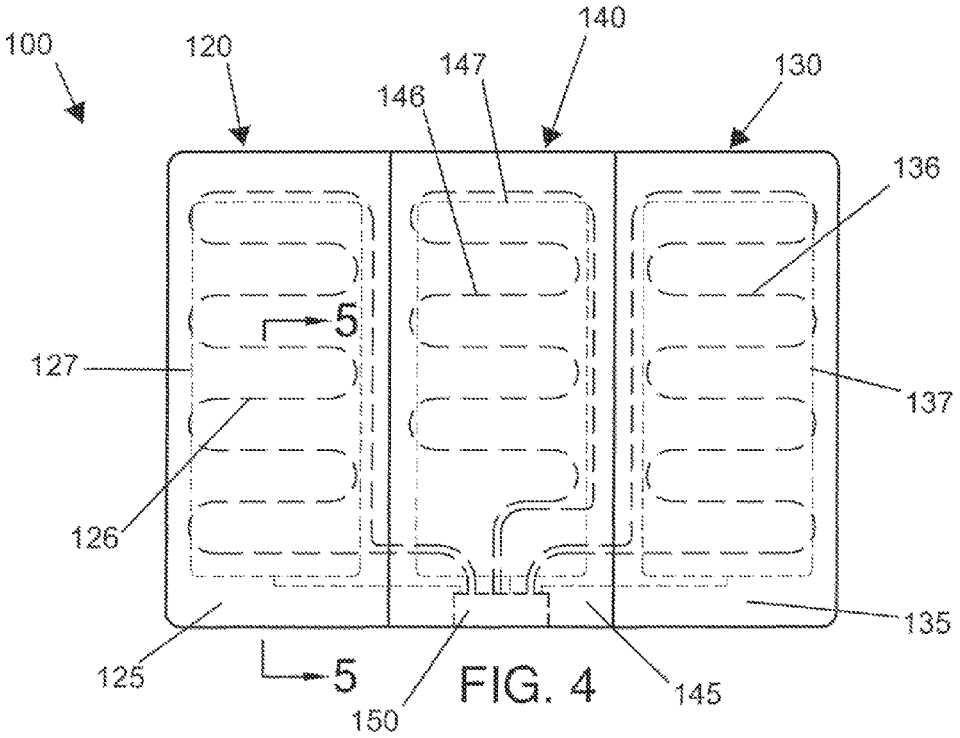
FIG. 4 shows a cutaway view of the top of the present invention.
Figure 5:
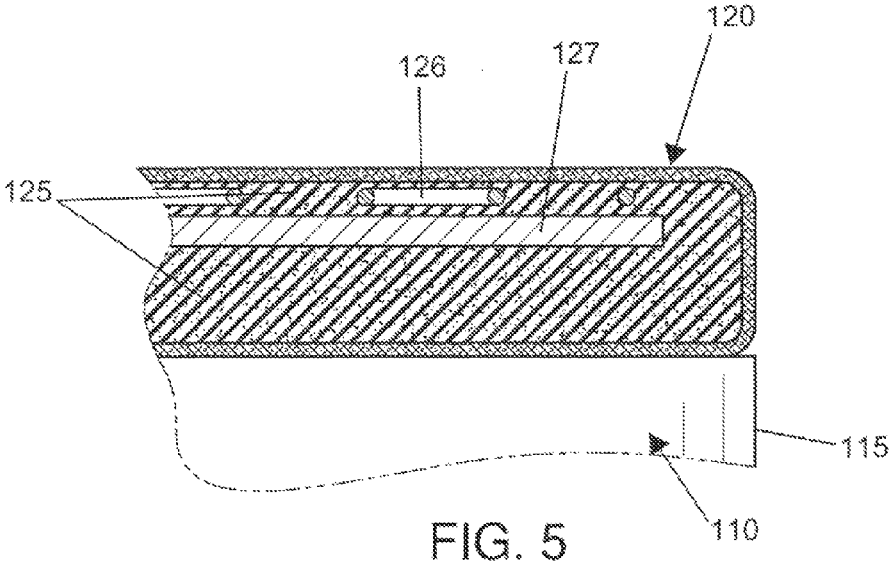
FIG. 5 shows a cutaway view of the side of the present invention.

Following is a list of elements corresponding to a particular element referred to herein:

100 Massaging system
110 Ottoman base
111 Base top surface
112 Base first side
113 Base second side
114 Base front side
115 Base rear side
120 First cushion
121 First cushion first side
121*a* First cushion first side edge
122 First cushion second side
122*a* First cushion second side edge
123 First cushion angle
125 First cushion component
126 First heating element
127 First massaging component
130 Second cushion
131 Second cushion first side
131*a* Second cushion first side edge
132 Second cushion second side
132*a* Second cushion second side edge
133 Second cushion angle
135 Second cushion component
136 Second heating element
137 Second massaging component
140 Third cushion
141 Third cushion first side
141*a* Third cushion first side edge
142 Third cushion second side
142*a* Third cushion second side edge
145 Third cushion component
146 Third heating element
147 Third massaging component
150 Power supply
160 Detachable cord
170 Power switch
180 Storage compartment
181 Cover
190 Triangular tunnel Referring now to FIG. 1-5, the present invention features a massaging system (100) with an ottoman having a positionable cushion adapted to at least partially surround an appendage of a user for massaging the appendage. In some embodiments, the system (100) comprises an ottoman base (110) having a base top surface (111), a base first side (112), a base second side (113), a base front side (114), and a base rear side (115). In some embodiments, the system (100) comprises a first cushion (120), a second cushion (130), and a third cushion (140) located on the base top surface (111).

In some embodiments, the first cushion (120) comprises a first cushion first side (121) and a first cushion second side (122). In some embodiments, the first cushion first side (121) is located next to the base first side (112) and runs from the base front side (114) to the base rear side (115). In some embodiments, the first cushion (120) comprises a first cushion component (125) located therein. In some embodiments, a first heating element (126) is located therein. In some embodiments, a first massaging component (127) is located beneath the first heating element (126) therein. In some embodiments, the first cushion component (125) fully surrounds the first heating element (126) and the first massaging component (127). In some embodiments, the first cushion (120) comprises a first cushion first side (121) having a first cushion first side edge (121*a*) and a first cushion second side (122) having a first cushion second side edge (122*a*).

In some embodiments, the second cushion (130) comprises a second cushion first side (131) and a second cushion second side (132). In some embodiments, the second cushion second side (132) is located next to the base second side (113) and runs from the base front side (114) to the base rear side (115). In some embodiments, the second cushion (130) comprises a second cushion component (135) located therein. In some embodiments, a second heating element (136) is located therein. In some embodiments, a second massaging component (137) is located beneath the second heating element (136) therein. In some embodiments, the second cushion component (135) fully surrounds the second heating element (136) and the second massaging component (137). In some embodiments, the second cushion (130) comprises a second cushion first side (131) having a second cushion first side edge (131*a*) and a second cushion second side (132) having a second cushion second side edge (132*a*).

In some embodiments, the third cushion (140) comprises a third cushion first side (141) and a third cushion second side (142). In some embodiments, the third cushion (140) is located between the first cushion second side (122) and the second cushion first side (131) and runs from the base front side (114) to the base rear side (115). In some embodiments, the third cushion (140) comprises a third cushion component (145) located therein. In some embodiments, a third heating element (146) is located therein. In some embodiments, a third massaging component (147) is located beneath the third heating element (146) therein. In some embodiments, the third cushion component (145) fully surrounds the third heating element (146) and the third massaging component (147). In some embodiments, the third cushion (140) comprises a third cushion first side (141) having a third cushion first side edge (141*a*) and a third cushion second side (142) having a third cushion second side edge (142*a*).

In some embodiments, the third cushion (140) is stationary.

In some embodiments, the first cushion second side (122) is pivotally located on the third cushion first side (141). In some embodiments, the first cushion (120) is affixedly positionable at a first cushion angle (123) with respect to the third cushion (140). In some embodiments, the first cushion (120) is pivotally attached via cloth. In some embodiments, the first cushion (120) is held in place via a prop rod, or a tensioning system.

In some embodiments, the first cushion angle (123) is between 0 and 180 degrees. In some embodiments, the first cushion angle (123) is 15 degrees. In some embodiments, the first cushion angle (123) is 30 degrees. In some embodiments, the first cushion angle (123) is 45 degrees. In some embodiments, the first cushion angle (123) is 60 degrees. In some embodiments, the first cushion angle (123) is 75 degrees. In some embodiments, the first cushion angle (123) is 90 degrees. In some embodiments, the first cushion angle (123) is 105 degrees. In some embodiments, the first cushion angle (123) is 120 degrees. In some embodiments, the first cushion angle (123) is 135 degrees. In some embodiments, the first cushion angle (123) is 150 degrees. In some embodiments the first cushion angle (123) is 165 degrees.

In some embodiments, the second cushion first side (131) is pivotally located on the third cushion second side (142). In some embodiments, the second cushion (130) is affixedly positionable at a second cushion angle (133) with respect to the third cushion (140). In some embodiments, the second cushion (130) is pivotally attached via cloth. In some embodiments, the second cushion (130) is held in place via a prop rod, or a tensioning system.

In some embodiments, the second cushion angle (133) is between 0 and 180 degrees. In some embodiments, the second cushion angle (133) is 15 degree In some embodiments, the second cushion angle (133) is 30 degrees. In some embodiments, the second cushion angle (133) is 45 degrees. In some embodiments, the second cushion angle (133) is 60 degrees. In some embodiments, the second cushion angle (133) is 75 degrees. In some embodiments, the second cushion angle (133) is 90 degrees. In some embodiments, the second cushion angle (133) is 105 degrees. In some embodiments, the second cushion angle (133) is 120 degrees. In some embodiments, the second cushion angle (133) is 135 degrees. In some embodiments, the second cushion angle (133) is 150 degrees. In some embodiments, the second cushion angle (133) is 165 degrees.

In some embodiments, when the first cushion (120) is pivoted to the first cushion angle (123) and the second cushion (130) is pivoted to the second cushion angle (133) the first cushion (120) attaches to the second cushion (130) to hold position.

In some embodiments, the system (100) comprises a power supply (150). In some embodiments, the power supply (150) is operatively connected to the first heating element (126), the second heating element (136), the third heating element (146), the first massaging component (127), the second massaging component (137), and the third massaging component (147). In some embodiments, the first heating element (126), the second heating element (136), the third heating element (146), the first massaging component (127), the second massaging component (137), and the third massaging component (147) each have separate operational controls.

In some embodiments, the first cushion (120), the second cushion (130), and the third cushion (140) are designed to enclose an appendage of a user on three sides. In some embodiments, the first cushion (120), the second cushion (130), and the third cushion (140) surround the appendage by making a shape of a completed triangle. In some embodiments, the first cushion (120), the second cushion (130), and the third cushion (140) surround the appendage by making three sides of a polygon. In some embodiments, a triangular tunnel (190) is formed when the third cushion first side edge (141*a*) meets with the first cushion second side edge (122*a*), and the first cushion first side edge (121*a*) meets with the second cushion second side edge (132*a*), and the second cushion first side edge (131*a*) meets with the third cushion second side edge (142*a*).

In some embodiments, the power supply (150) is a battery. In some embodiments, the power supply (150) is located in the third cushion (140). In some embodiments, the battery is rechargeable. In some embodiments, the battery is recharged via alternating current electricity via connecting a detachable cord (160) to the battery and an alternating current outlet. In some embodiments, the detachable cord (160) comprises a power switch (170) located thereon. In some embodiments, the base rear side (115) comprises a storage compartment (180) for storing the detachable cord (160). In some embodiments, the storage compartment (180) comprises a cover (161) pivotally located thereon. In some embodiments, the power supply (150) is alternating current electricity.

In some embodiments, the first cushion component (125), the second cushion component (135), and the third cushion component (145) each comprise memory foam. In some embodiments, the first cushion component (125), the second cushion component (135), and the third cushion component (145) each comprise foam. In some embodiments, the first cushion component (125), the second cushion component (135), and the third cushion component (145) each comprise an air cushion. In some embodiments, the first cushion component (125), the second cushion component (135), and the third cushion component (145) each comprise a water cushion.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures.

The reference numbers recited in the below claims are solely for ease of examination of this patent application, and are exemplary, and are not intended in any way to limit the scope of the claims to the particular features having the corresponding reference numbers in the drawings.

What is claimed is:

1. A massaging system (100) featuring an ottoman with a positionable cushion adapted to at least partially surround an appendage of a user, wherein the system (100) comprises:

(a) an ottoman base (110) having a base top surface (111), a base first side (112), a base second side (113), a base front side (114), and a base rear side (115);

(b) a first cushion (120), a second cushion (130), and a third cushion (140) disposed on the base top surface (111), wherein the first cushion (120) comprises a first cushion first side (121) having a first cushion first side edge (121*a*) and a first cushion second side (122) having a first cushion second side edge (122*a*), wherein the first cushion first side (121) is disposed adjacent to the base first side (112) from the base front side (114) to the base rear side (115), wherein the first cushion (120) comprises a first cushion component (125) disposed therein, wherein a first heating element (126) is disposed therein, wherein a first massaging component (127) is disposed beneath the first heating element (126) therein, wherein the first cushion component (125) fully surrounds the first heating element (126) and the first massaging component (127), wherein the second cushion (130) comprises a second cushion first side (131) having a second cushion first side edge (131*a*) and a second cushion second side (132) having a second cushion second side edge (132*a*), wherein the second cushion second side (132) is disposed adjacent to the base second side (113) from the base front side (114) to the base rear side (115), wherein the second cushion (130) comprises a second cushion component (135) disposed therein, wherein a second heating element (136) is disposed therein, wherein a second massaging component (137) is disposed beneath the second heating element (136) therein, wherein the second cushion component (135) fully surrounds the second heating element (136) and the second massaging component (137), wherein the third cushion (140) comprises a third cushion first side (141) having a third cushion first side edge (141*a*) and a third cushion second side (142) having a third cushion second side edge (142*a*), wherein the third cushion (140) is disposed between the first cushion second side (122) and the second cushion first side (131) from the base front side (114) to the base rear side (115), wherein the third cushion (140) comprises a third cushion component (145) disposed therein, wherein a third heating element (146) is disposed therein, wherein a third massaging component (147) is disposed beneath the third heating element (146) therein wherein the third cushion component (145) fully surrounds the third heating element (146) and the third massaging component (147), wherein the third cushion (140) is stationary, wherein the first cushion second side (122) is pivotally disposed on the third cushion first side (141), wherein the first cushion (120) is affixedly positionable at a first cushion angle (123) with respect to the third cushion (140), wherein the second cushion first side (131) is pivotally disposed on the third cushion second side (142), wherein the second cushion (130) is affixedly positionable at a second cushion angle (133) with respect to the third cushion (140); and (c) a power supply (150), wherein the power supply (150) is operatively connected to the first heating element (126), the second heating element (136), the third heating element (146), the first massaging component (127), the second massaging component (137), and the third massaging component (147), wherein the first cushion (120), the second cushion (130), and the third cushion (140) are designed to enclose an appendage of a user on at least three sides, wherein a triangular tunnel (190) is formed when the third cushion first side edge (141*a*) meets with the first cushion second side edge (122*a*), and the first cushion first side edge (121*a*) meets with the second cushion second side edge (132*a*), and the second cushion first side edge (131*a*) meets with the third cushion second side edge (142*a*).

2. The system (100) of claim 1 wherein the power supply (160) is a battery.

3. The system (100) of claim 2, wherein the power supply (150) is disposed in the third cushion (140).

4. The system (100) of claim 2, wherein the battery is rechargeable, wherein the battery is recharged via alternating current electricity via connecting a detachable cord (160) to the battery and an alternating current outlet.

5. The system (100) of claim 4, wherein the detachable cord (160) comprises a power switch (170) disposed thereon.

6. The system (100) of claim 4, wherein the base rear side (115) comprises a storage compartment (180) for storing the detachable cord (160), wherein the storage compartment (180) comprises a cover (181) pivotally disposed thereon.

* * * * *